US008931578B2

(12) United States Patent
Jette et al.

(10) Patent No.: US 8,931,578 B2
(45) Date of Patent: Jan. 13, 2015

(54) ROBOTIC TUNNELING SYSTEM

(76) Inventors: Bruce Donald Jette, Burke, VA (US); Joseph Buford Parse, Stow, MA (US)

( * ) Notice: Subject to any disclaimer, the term of this patent is extended or adjusted under 35 U.S.C. 154(b) by 307 days.

(21) Appl. No.: 13/530,582

(22) Filed: Jun. 22, 2012

(65) Prior Publication Data

US 2012/0325555 A1 Dec. 27, 2012

Related U.S. Application Data

(60) Provisional application No. 61/499,853, filed on Jun. 22, 2011.

(51) Int. Cl.
*E21B 44/00* (2006.01)
*E21B 7/26* (2006.01)
*E21B 4/18* (2006.01)

(52) U.S. Cl.
CPC ..... *E21B 7/265* (2013.01); *E21B 44/00* (2013.01); *E21B 44/005* (2013.01); *E21B 4/18* (2013.01)
USPC ..... 175/24; 175/94

(58) Field of Classification Search
CPC ..... E21B 7/00; E21B 7/04; E21B 7/06
USPC ..... 175/24, 57, 94
See application file for complete search history.

(56) References Cited

U.S. PATENT DOCUMENTS

| | | | | |
|---|---|---|---|---|
| 4,085,808 | A | 4/1978 | Kling | |
| 7,457,698 | B2 * | 11/2008 | Danko | 701/50 |
| 2006/0042835 | A1 | 3/2006 | Guerrero et al. | |
| 2008/0135292 | A1 | 6/2008 | Sihler et al. | |

OTHER PUBLICATIONS

International Search Report and Written Opinion of the International Searching Authority issued for corresponding international application No. PCT/US2012/043764, completed on Aug. 24, 2012 and mailed on Sep. 13, 2012.

* cited by examiner

*Primary Examiner* — William P Neuder
(74) *Attorney, Agent, or Firm* — Goodman Allen & Filetti PLLC; Charles M. Allen, Esquire; Matthew R. Osenga, Esquire

(57) ABSTRACT

A tunneling system is disclosed that includes a surface power-controller, umbilical tether, robotic tender, and robotic tunneling device. This system allows the robotic tunneling device to efficiently create new tunnels using the power and fluids provided from the surface through the robotic drilling tender, as well as a way to efficiently manage cuttings below surface. The system is designed to operate not only when the well is not producing, but also on a continuous basis while the well is producing.

27 Claims, 14 Drawing Sheets

ROBOTIC TUNNELING SYSTEM

CROSS-REFERENCE TO RELATED APPLICATION

This application claims the benefit of U.S. Provisional Application No. 61/499,853, filed Jun. 22, 2011, the contents of which are incorporated herein by reference.

FIELD OF THE INVENTION

The present invention relates generally to underground drilling systems and more particularly to robotic tunneling systems.

BACKGROUND OF THE INVENTION

Production fluids, oil and natural gas, from a reservoir are recovered by drilling wells at a spacing which allows for optimal recovery. Optimization is based on the characteristics of the reservoir rock, fluids, and the pressure along with cost of the wells. The natural permeability of the rock allows for fluid flow through the rock from regions of higher to lower pressure. Rock with low permeability may contain significant quantities of production fluids. The longer the path from the fluids at high pressure in the rock to a low pressure region in the well, the greater the restriction on production rate from that rock. The lower the permeability of the rock for a given fluid pressure and path length, the sooner production will drop off. While the fluids will continue to migrate through the low permeability rock from the residual high to low pressure region, the production rate of the well may not produce sufficient financial resources to warrant further recovery which will leave reserves in the ground as unrecoverable.

Natural fissures in the rock provide pathways of greater permeability and can allow production fluids to move along more efficient paths from the reservoir rock to the well bore if the well bore communicates with these natural fissures. Initial rates of recovery may not be improved significantly, but the period over which the rate remains higher and, therefore, more economically viable to recovery is extended. This, in turn, allows for greater drainage of the reservoir since any given segment of the high pressure fluids trapped in the low permeability rock will have a shorter pathway to travel before being recovered. However, even under these conditions the total reserves which are economically recoverable may be limited by the permeability of the rock and the distance any portion of the reservoir fluid must travel through that rock before encountering a natural fissure which communicates with the well bore.

Most reservoirs exhibit greater horizontal dimensions than vertical. A single well drilled vertically through a reservoir provides for communications between the well and the reservoir rock only in association with the vertical dimension. Such wells are most often completed by cementing steel casing to the well bore and perforating the steel and cement using small shaped charges spaced within the vertical dimension. If the rock has low permeability as discussed above, the rate of production is limited by the communications these perforations have with naturally occurring fractures or the movement of the fluid through the rock itself.

To increase the likelihood of communications with natural fractures or the reservoir rock, technologies and methodologies for deviating from vertical wells to horizontal wells were developed. This allowed the well bore to be changed from vertical to horizontal such that it extended through the reservoir taking advantage of the larger horizontal dimensions.

Such wells may be completed as with vertical wells having casing cemented along the length of the horizontal segment and perforated extensively, or the horizontal segment may be left open hole. Each method has its advantages. However, once completed, the well will be in communication with a set number of natural fissures or reservoir rock. While improved, the well will encounter reductions in production rate over time and economically recoverable reserves will be somewhat better, but not as much as available.

Hydraulic fracturing has been developed to enhance communication between the reservoir and the well bore. Hydraulic pressure is applied to the formation through perforations in a cemented and cased segment of either a horizontal or vertical well bore. This pressure causes the formation rock to fracture opening new pathways for the production fluids to flow. In many cases, these fractures are enhancements to or intersect with natural fractures as is seen by their preferential orientation with the existing stresses in the formation. Like many naturally occurring fractures, hydraulic fractures may close up upon release of the hydraulic pressure allowing the rock to reduce or eliminate the channel created. To mitigate this, proppant such as sand or ceramics is pumped into the well to prevent this closure from fully occurring. The resulting propped segment of the fracture will have permeability associated with the specific proppant at the formation closure pressures. Studies indicate that while the hydraulic fractures may extend for as much as 1000 feet, proppant tends to settle out of the fracturing fluid in approximately 200 feet. This means that communications is significantly less than that possible due to the hydraulically produced fracture and that fewer natural fractures are encountered by the usable hydraulic fracture.

While limited, these advances in reservoir recovery have made significant improvements to the rate of production, drop-off rate, and total recoverable reserves. They have, in fact, opened up reserves that were heretofore not considered economically recoverable. The maturation of the technologies has also allowed reservoir and well engineers to improve designs of well spacing of a field.

Assuming the value of produced fluids and the cost of a given well design, not only can the well be optimized, but also the spacing of those wells. Since wells are expensive to drill and being able to drain a larger area from a single well would mean fewer wells, there is significant savings resulting from further improvements. Additionally, increasing communications with the reservoir in a cost effective manner would increase the rate of production, decrease the rate at which this rate declines, and generally make a larger portion of the possible reserves to be considered recoverable.

However, once designed, drilled, and completed, wells are not normally enhanced. Some wells which were never fractured have resulted in improving recovery. If the economics of recovery change, then more wells are normally drilled with all the commensurate costs.

While this discussion has focused on wells drilled in low permeability rock, it generally applies as well to wells with higher permeabilities, especially if the reservoir pressure has been depleted. While there may be more production fluid in the reservoir, it may be non-recoverable due to the loss of motivating pressures. This has resulted in secondary recovery methods such as pumping to reduce the low side backpressure and tertiary recovery that stimulates movement by creating various sources of pressure or chemical gradients such as with water or $CO_2$ flood. Both cases would benefit from improved communications between the well and the reservoir rock. In the case of tertiary recovery where there is normally a stimulation well, such as a water injection well, enhanced communications would benefit both the stimulation as well as production wells.

Recovery from wells containing rock or bituminous materials, such as tar sands and carbonatious reservoirs, are often stimulated into recovery by Steam Assisted Gravity Drained (SAGD). In this method, a horizontal well is drilled in the reservoir above and parallel to another horizontal well. Steam is injected into the higher well reducing the viscosity of the hydrocarbons in the rock and allowing them to flow through the rock to the lower well for capture and recovery. While effective, this technique is constrained by the possible size of the steam plume within the rock, the distance between the upper and lower wells, and their possible spacing. Here, natural fractures or their simulation would not be of as significant value as simply more wells parallel to one another. But, economics dictate the initial and, often, final spacing.

Well costs dictate the well design and spacing for a given reservoir and assumed production fluid value. Once produced, few fields can be significantly improved without drilling additional wells on smaller spacing. For any given well design, most often the most significant cost of the well is in completing that portion which is simply there to get to the reservoir, the vertical component. Often a well will be 6,000 to 8,000 feet Total Vertical Depth (TVD) and extend only 1,000 feet horizontally with the vertical and turning segments of the well cemented and cased. The cost of drilling and completion often prevent multiple horizontal segments off the same vertical well and when it is done, only a few are drilled. An additional pressure on further drilling from a given well is the delay to getting it into production. Wells not connected to the production system do not produce revenue but only cost.

It would, therefore, be beneficial to have a system and method that could create more intimate contact with the reservoir, do so without the need for adding the vertical component of a well, and allow for continued improvement to the well over time without effecting production.

Drilling while producing has been employed in the past primarily as a result of underbalanced drilling techniques. It reduces reservoir damage during production and provides some revenue in the process. But it is not employed once the well is completed.

To increase the communications between the well and the reservoir, a system is needed to increase the total surface of the production rock in contact with a connection to the well bore or the number of natural or hydraulic fractures connected to the well bore. This can be accomplished by adding more well bore to the existing well. In addition to drilling a limited number of additional horizontal wells segments from a single vertical well, in the past one such technique employed has been coil tube drilling to produce herringbone extensions from an existing well. While a coil tube can add total well bore surface area, it has been limited by the length of the coil tube, its cost due to the limited number of times a single coil can be reused, and the requirement that the well not be in production at the time of drilling. Coil tube drilling has also been used to re-enter a well to add herringbone segments. While this adds applicability to the technique, it does not resolve the inherent limitations listed.

Whether using coil tube or conventional drilling methodology to produce an additional well bore, the well must be off production with the exception of the temporary and unusual underbalanced drilling technique. This motivates completing the well and not reopening it for further changes or improvements unless absolutely necessary.

An innovative approach would be to create a device and its method of use to allow continuous improvement of an initial well, horizontal or vertical, without requiring the well to be removed from production. This implies an automated or robotic system that operates continuously subsequent to the well being placed into production.

Robotics has been applied to drilling, but the majority of approaches have been to provide safer and more effective automation of surface activities. Automated tongues for breaking and joining drill stems are an example. Automaton and robotic handling of drill stems or collars have also been developed. A number of drilling rigs have been nearly fully automated and could even be considered to be partially robotic by essentially executing the same tasks that have otherwise been done by a trained crew. Some off-shore platforms provide a combination of these capabilities along with very sophisticated and automated controls for platform positioning.

Down-hole robotics have been limited. In one unpublished study, a drilling robot was developed which was tethered to a power and control system. As the robotic drill created a hole by the drill bit at the front end, it passed the cuttings to the back of the robot where it attempted to pack them into the hole already made. This effort failed due to entropy in that for hard rock it was impossible to continue the process without ultimately sticking the robot. A second commercial system that was to drill a specific and relatively short distance straight down into a formation suffered from much the same difficulties sticking in the hole before achieving the desired depth. The US military has also used robotic drilling systems that were un-tethered and designed to penetrate hard rock a short relatively short distance. In this case, the power for the drill produced significant exhaust which was used to clear the hole. However, this system was limited to single shallow dry hard rock holes. None of these efforts showed the essential integration of features to allow continuous drilling and improvement to an existing well. Instead, they indicated that a robotic system must include disposal or otherwise resolution of the cuttings accumulation and control of the drilling system. In the case of a clean hole, a tether was an acceptable feature and more desirable than a single use system.

Control of a robot down-hole would depend on sensors that could detect position, orientation, and distance traveled. Pipe robots offer methods of discerning these position characteristics and, with increased sophistication in directional drilling, techniques can be applied to properly locate all components down hole. A particular advantage that an integrated system would have is the potential for cooperation between components.

In addition, sensors could be added that also detect formation characteristics and inform further progress which is managed either autonomously or by intervention. In fact, a robotic sub-surface sensor platform has been proposed which has a tethered component and the ability to allow an individual robotic sensor package to move into the formation, gather information, and return for download. This system acts as essentially a wire-line system with the addition of robotic sensor gathering packages. Much like the pipe robots or the sub-surface positioning systems in existence, the robotic sensor package provides no more than insight into relevant sensors for surveying that may facilitate a fully integrated robotic drilling system. Additionally, all these systems require ongoing operations or production to cease while they are in use.

What is needed is a robotic drilling system which, while the well remains in production, can be operated continuously in order to produce an additional well bore for improved communications between the main well bore and the reservoir rock, natural fractures, or hydraulic fractures. Any drilling component of the system must have one or more methods of eliminating cuttings to reduce the chance of the drilling device sticking in the hole it creates. The system should provide for sufficient sensory data to allow automation of the device and component positioning, relative positioning, orientation, and condition. Furthermore, the device should allow integration of appropriate real-time sensors which will allow for improvement of the drilling and positioning process within the reservoir.

SUMMARY OF THE INVENTION

The invention relates to various exemplary embodiments, including systems, components, products, and methods of using the same.

These and other features and advantages of exemplary embodiments of the invention are described below with reference to the accompanying drawings.

DETAILED DESCRIPTION

Figure 1:
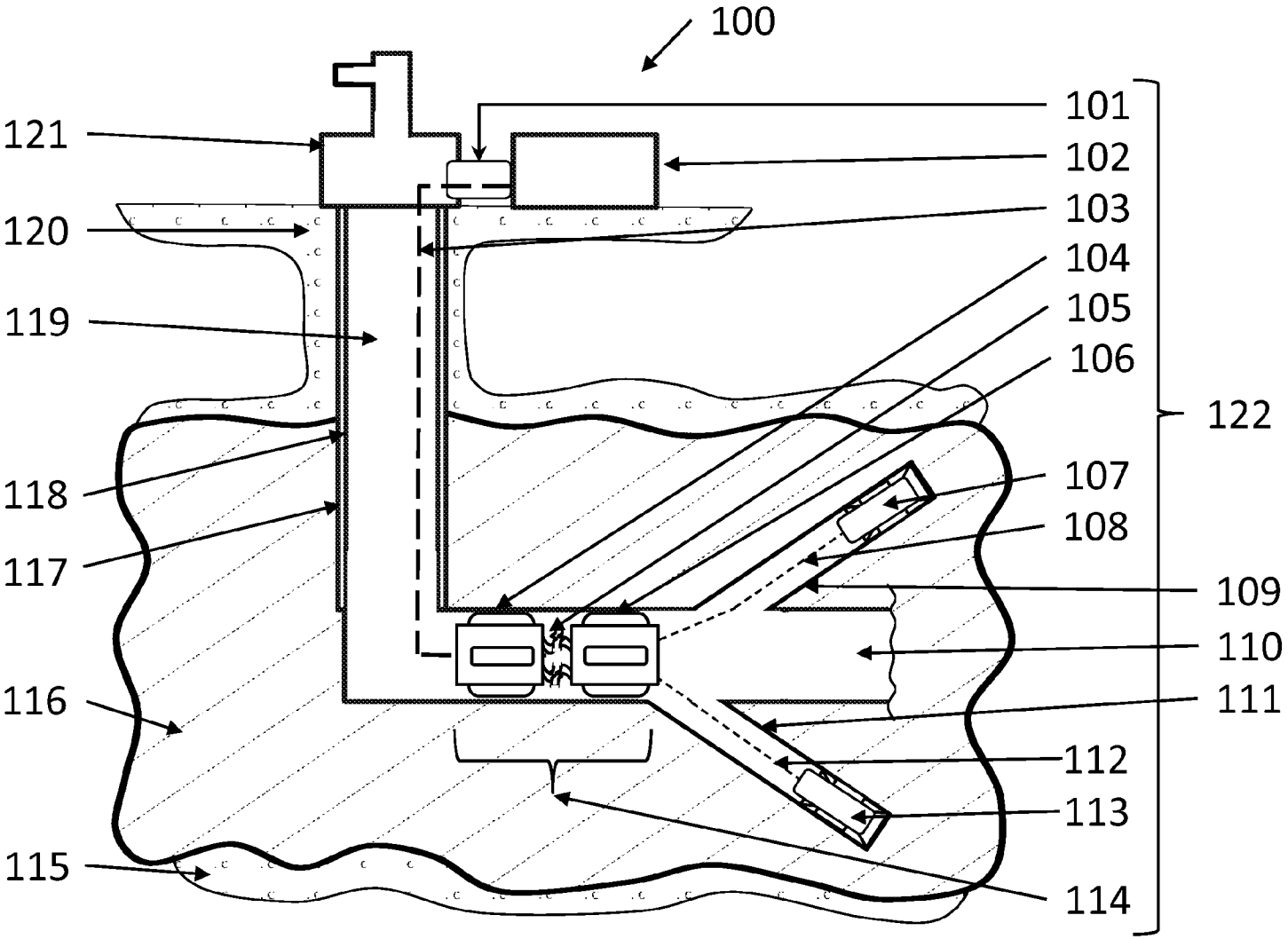
FIG. 1 is a schematic representation of the robotic drilling system according to the present invention as deployed in a formation.

In the following detailed description, numeric values and ranges are provided for various aspects of the implementations described. These values and ranges are to be treated as examples only and are not intended to limit the scope of the claims. In addition, a number of materials are identified as suitable for various facets of the implementations. These materials are to be treated as exemplary and are not intended to limit the scope of the claims.

The invention relates to a drilling system that includes a surface controller, tether, robotic tender, and robotic drills that may be employed prior to or during well production having the purpose of increasing the total communications with the reservoir through the production of additional well bore. The surface controller provides communications, computational control, power, and tether management between the surface and those components in the well. A fitting on the wellhead allows for the tether to be fed from surface to subsurface through the well bore without loss of a production pathway to the downstream system, if desired. The tether is a multi-component entity which, in one implementation, incorporates a line for drilling fluid, a return line for cuttings and used drilling fluids, a power line, and a communications line all encapsulated in a strength bearing and protective cover. The main tether is between the surface controller and the robotic tender. The robotic tender, in one implementation, is includes two sub-components: the robotic management tender and the robotic tunneling tender. The robotic management tender includes a sealed vessel connected at one end to the main tether and which has locomotion capabilities through an externally mounted traction or inchworm system which does not impede the flow of fluid from the well around the body of the device. Internal to the vessel is a control system that accepts drilling fluid from the main tether, manages pressure to the robotic drill(s), and distributes the drilling fluid to the intermediate tether(s). Internal to the vessel is a control system that accepts used drilling fluid which contains residue from the formation and drilling process from the intermediate tether(s), manages its pressure, and passes it to the main tether for subsequent surface management. Internal to the controller vessel is a power conversion and management system. This system, in one implementation, accepts current and voltage from the main tether; converts it to current, voltage, and modulation suitable for internal and subsequent components; and manages its distribution to the intermediate tether(s) for subsequent application. Internal to the vessel is a control system which accepts and provides communications signals between the surface controller and the robotic tunnel tender and between the robotic tunneling tender and the subsequent system components via the intermediate tether(s). Internal to the vessel are sensors that provide information for the operation of the system such as but not limited to position, direction, attitude, distance moved, fluid flows and pressures, pump and mechanical component statuses, electrical component statuses, and mechanical integrity. Additionally, sensors that provide insight into the reservoir and reservoir fluids may be incorporated such as but not limited to temperature, pressure, and surface morphology. The intermediate tether, in one configuration, includes components comparable to those of the main tether but scaled to the needs of the subsequent components. Should multiple robotic drills be employed, each would have an individual intermediate tether attached. This or these intermediate tethers would be passed through the second component of the robotic tender: the robotic drill tender. The robot drill tender manages the feed of the intermediate tethers to facilitate tether feed to the robotic drill(s). Like the robotic management tender, the robotic drill tender includes a sealed vessel which, in one configuration, passes the intermediate tether(s) through a tether control system and subsequently through the body. The robot drill tender has locomotion capabilities through an externally mounted traction or inchworm system which does not impede the flow of fluid from the well around the body of the device. Internal to the robot drill tender is a power management system for internal controls, sensors, and locomotion. Also, internal to the vessel are sensors which provide information for the operation of the system such as but not limited to position, direction, attitude, distance moved, tether position, mechanical component statuses, electrical component statuses, and mechanical integrity. Additionally, sensors that provide insight into the reservoir and reservoir fluids may be incorporated such as but not limited to temperature, pressure, and surface morphology. Sensors in the robot management tender and the robot drill tender may be arranged to cooperate in order to provide greater information than can be achieved by an individual component such as relative and specific position, robotic drill position, formation characteristics, and production fluid characteristics. In addition to managing the intermediate tether(s) and providing sensor data, the robot drill tender provides a deployment bay for storing and deploying a robot drill. This deployment bay allows pass-through of the intermediate tether and, when held within, provides the robot drill with protection from the well environment. The deployment bay can be oriented in a fixed manner, its primary configuration, to direct the robot drill into the wall of the well bore allowing it to establish a branch well bore. The robot drill includes a fluid management system, a sensor and control system, a power management system, and a locomotion system integrated into a single component. The robot drill includes a housing that is smaller than the diameter of the branch well bore to be drilled. At the back end of the robot drill is an adapter that connects the intermediate tether and each of its internal components to the appropriate internal systems. The drilling fluid source hose is connected to a fitting that, in one implementation, directs the drilling fluid to the interior of a hollow central drive shaft that transfers power from the drive source to the drill bit. Fluid is flushed out the front of the drill bit and cuttings, formation fluids, and spent drilling fluid travels rearward along the sides of the robot drill until it encounters, in one implementation, a reamer-grinder. This reamer-grinder ensures that no cutting larger than a design size passes without being reduced to the design size. These smaller cuttings and fluid pass under pressure into a slotted capture chamber rearward of the reamer-grinder but in front of a seal which has the purpose of significantly reducing passage of cuttings to the rear of the robot drill body and into the branch well bore. This reduces likelihood of cuttings accruing behind the robot drill and causing a stuck robot drill. Additionally, the rear seal can be retracted to allow for removal of any debris that may accumulate in the branch well bore behind the robot drill, and the reamer-grinder can facilitate reduction of larger items that may also inhibit movement. Power provided to the robot drill provides for sensors, computation, communications, locomotion, and, in one implementation, power to the drill bit. Power to the bit, in this implementation, is achieved through one or more electric motors which provide power to the drill bit through a central drive shaft that may be geared before connecting with the drill bit. These connections may be fixed or articulated. The robot drill has locomotion capabilities through an externally mounted traction or inchworm system that does not impede the flow of fluid from the well around the body of the device. This locomotion system also provides the weight-on-bit necessary for the drilling action at the leading edge of the drill bit. Internal to the robot drill is an electronic control system that controls all components previously described comprising the robot drill. Additionally, the electronic control system communicates with internal sensors which provide information for the operation of the system such as but not limited to position, direction, attitude, distance moved, mechanical component statuses, electrical component statuses, and mechanical integrity and sensors which provide insight into the reservoir and reservoir fluid characteristics such as but not limited to temperature, pressure, and surface morphology.

The one or more robotic drills are housed in the robotic drill tender. The robotic drill tender, intermediate tether, and robotic management tender are lowered into the well through the cased well bore into the uncased well bore. The robotic management tender is positioned using its sensors and locomotion system. The main tether is paid-out by the surface controller through the tether conveyer while retaining a seal with the well production channel. The robotic drill tender moves to a position using its locomotion system to initiate drilling by the robotic drill(s). The distance between the robotic management tender and the robotic drill tender is initially established to ensure good management of the intermediate tether. The robotic drill tender orients the robotic drill(s) for initial penetration of the well bore under the control of surface controller. The robotic drill(s) drills into the formation establishing a branch well bore. As the robotic drill(s) penetrate, the robotic management tender moves closer to the robotic drill tender providing slack to the intermediate tether. The main tether is paid-out under the control of the surface controller to allow the robotic management tender to move forward. Once the total depth of the branch well bore is achieved, the robotic drill(s) moves back through the branch well bore and into the robotic drill tender. The robotic management tender moves back up the well bore to take up slack in the intermediate tether while the surface controller takes up slack in the main tether. The robotic tender system jointly moves to the next position or orientation to initiate the next branch well bore(s) and repeats the process.

The robotic drill maintains control of the cuttings by capturing the majority of them in an integrated removal system at the rear of the vessel body and transporting them back to the robotic management tender through a component of the intermediate tether where the robotic management tender passes the cuttings, drilling fluid, and production fluids captured to the surface controller via the main tether. Fresh drilling fluid and power are provided to the system via an internal component of the main and intermediate tethers under the control of the surface controller and based upon sensory data provided by the robotic drilling system components.

Because the main and intermediate tethers and the robotic tender system are designed to never occlude the well bore, the well production channel remains open to production. In this way, the entire system can operate without requiring the well to be shut-in. This allows the well to be connected to the downstream production system while the well bore is specifically extended and enhanced to increase production and total recovery.

The present invention provides a system and method for a robotic drilling system which creates multiple well bores subsequent to the main well bore without requiring the cessation of production of the well. The system includes surface and sub-surface robotic components that are in communication via a tether system that together form the robotic drilling system. A surface control system allows continued production of the well while managing the main tether to the sub-surface robotic systems. The sub-surface components manage the tether, power, communications, sensory data, production fluids, and cutting fluids as one or more robotic drills creates additional branched well bores off of the main well bore. These branched well bores may be symmetric or asymmetric to the well bore and horizontal, vertical, or in any orientation with respect to vertical that allows the optimal recovery from the reservoir. Additionally, the depth and number of multiple branched well bores may be drilled in order to optimize recovery from the reservoir. Specific to the design of this robotic drilling system is that it allows production fluids to pass the sub-surface components while they are in operation thereby allowing the well to remain in production even while the well is continuously improved. The system can be operated autonomously, semi-autonomously, or manually. Sensors will be employed as part of the system components, particularly those that are sub-surface, to determine position, attitude, direction, rate of movement and penetration, and system component condition. Additional sensors may be employed to provide data about the formation and any production fluids to include but not limited to temperature, pressure, flow, viscosity, composition, rock composition, porosity, density, surface morphology, conductivity, and neutron absorption. Information gained by these sensors may be used by the surface control system to improve employment of the drilling system or to facilitate improved drilling.

While the specific implementation described here is primarily as a method of adding branch well bores from a main well bore, it is to be understood for the purposes of the present application that it can be used in many applications, including but not limited to, production of a main well bore for hydrocarbon recovery, production of a well bore for water recovery, production of branched well bore for use in water recovery, production of well bore for use in geothermal applications, production of branched well bore for use in geothermal applications, production of tunnels and pathways for infrastructure such as pipelines, electrical conduits, ventilation, waterlines, sewer and drain lines, for field drainage or sampling in pollution remediation, and for sensor fields.

Set forth below are various details of the present invention. However, it is to be understood that while specific implementations of the robotic drilling system are described, it is understood that each and every one of these implementations and features apply to the methods of their application and their uses.

The term "robotic" is used herein to refer to a system or component to which it is related may perform at the operator's discretion its function with at least some degree of autonomous control, semi-autonomous control, or manual control.

The term "autonomous" is used herein to refer to a system or component to which it is related may perform its function or a subset of its functions under the control of internal mechanisms such as but not limited to a computer and computer software, sensors, and actuators.

The term "semi-autonomous" is used herein to refer to a system or component to which it is related may perform its function or a subset of its functions under the control of a mixture of internal mechanisms such as but not limited to a computer and computer software, sensors, and actuators, external mechanisms such as but not limited to a computer and computer software, sensors, actuators and manual intervention or operations.

The term "manual control" as used herein refers to a system or component to which it is related may perform its function or subset of its functions under direct control of a human operator.

The term "reservoir" as used herein refers to a region of a formation which contains hydrocarbons to be recovered. A more general context is any sub-surface region into which the device is deployed to create well bore for a specific application.

An implementation of the invention is presented in the context of its application to recovery of hydrocarbon 100 in FIG. 1. This implementation is meant to provide an example and not a limitation to the specific construct or method of application of the system or its sub-systems. The implementation of the invention, the robotic drilling system 122, includes a surface controller 102 that is connected to the production head of a well 121 via the tender port 101 through which the main tether 103 passes to the robotic tender system 114 comprised of a robotic management tender 104, intermediate tethers 105, 108, 112, a robotic drill tender 106, and robotic drills 107,113. In the present implementation, the invention is presented deployed in a hydrocarbon producing well where the production well head 121 is at the top of a vertical well 118 which has been cased 117 to a just prior to a horizontal main well bore 110 in the reservoir 116 that has an overburden 120 and a supporting sub-surface layer 115.

The surface controller 102 provides power, communications, drilling fluids, capture, and treatment of cuttings and spent drilling fluids, to the sub-surface components via the main tether 103. The main tether also contains a strength member sufficient to allow recovery of the sub-surface components should powered recovery not be possible. The surface controller 102 also provides management of the main tether 103 as it is paid out or recovered. In addition, the surface controller 102 provides computational and human interface capability so that the system may be operated in autonomous, semi-autonomous, or manual modes. During operation of the sub-surface components, the main tether 103 may need to be paid out or recovered. The sub-surface components may also need to be recovered for maintenance or repair. The tender port 101 is meant to allow these tasks to be performed on a continuous or episodic basis without interrupting flow of production fluids through the production channel 119 to and out of the production head 121.

In the implementation shown, a multi-component robotic tender system 114 is presented. The robotic management tender 104 provides sub-surface management of power, communications, drilling fluids, passage of cuttings and spent drilling fluids as will be described in greater detail. An internal sensor system provides it with position, attitude, orientation, direction, and location information that can be communicated to the surface controller and autonomously, semi-autonomously, or manually result in proper positioning of the robotic management tender 104 within the main well bore 110 through its locomotion system. Possible application of external sensors which determine characteristics of reservoir and main well bore 110 fluids may also be integrated and be included in the control mechanisms for the robotic drilling system 122.

In one implementation, two intermediate tethers 105 are depicted which provide to the robotic drill tender 106 and robotic drills 107, 113 the same power, communications, drilling fluid supply, and drainage system as the main tether but subsequent to their management modifications by the robotic management tender 104. Each of these intermediate tethers 106, 112 pass through the robotic drill tender and connect directly to the robotic drills 107, 113.

In this implementation, the robotic drill tender 106 manages the intermediate tethers 105, 108, 112, provides the robotic drill a docking port during movement within the main well bore 110, and facilitates initiation of the branch well bore drilling sequence. For example, the robotic tender system 114 with the robotic drills 107, 113 housed in the docking ports move along the main well bore 110 to the position for initiation of branch well bore 109, 111 drilling with the distance between the robotic drill tender 106 and the robotic management tender 104 approximately the length of the intermediate tethers 105 in order to avoid sticking the system by the tethers. The length of these tethers may be defined by the design optimization of the field but may be as long as about 2000 feet, typically as long as about 1500 feet. Greater lengths are possible with modifications to the power tether system and the potential introduction of additional intermediate management system along the tether. The robotic drill tender 106 then orients the robotic drills 107, 113 to initiate drilling into the walls of the main well bore 110 to form the branch well bore 109, 111. As the robotic drills 107, 113 penetrate the reservoir 116 the intermediate tether attached to them must be slacked, which is accomplished under the control of the robotic drill tender 106 and by movement of the robotic management tender 104 forward. This requires the surface controller 102 to pass additional main tether 103 through the tender port 101. When maximum depth is achieved, this process is reversed in that the robotic drills 107, 113 move back to the robotic drill tender 106 which pays the intermediate tether 105, 108, 112 back into the main well bore 110 between it and the robotic management tender 104 which, in turn moves back up the main well bore 110 as the surface controller 102 recovers the main tether 103 through the tender port 101.

Once the same state as that of the system at initiation of drilling is achieved, additional branch well bores may be drilled by repositioning either the robotic drill tender 106 or the robotic tender system 114. For example, in FIG. 1 the branch well bores 109, 111 are meant to imply they have been drilled horizontally into the reservoir 116. Should the recovery design warrant, the robotic drill tender 106 could simply reorient the robotic drill orientation to any angle of inclination for subsequent drilling from the same position creating an array of branch well bores 109, 111 from the same initiation site. Or, the entire robotic tender system 114 could translate in the main well bore 110 to a new drill site. This would be accomplished by maintaining the spacing between the robotic management tender 104 and the robotic drill tender 106 commensurate with the length of the intermediate tether 105 while the surface controller 102 pays out main tether 103 through the tender port 101.

Upon completion of drilling all branch well bores 109, 111 or in the case of servicing or repair, the robotic drills 107, 113 would be withdrawn into the robotic drill tender 106 for storage in the robot dock, and the entire robotic tender system 114 moved back up the well bore 118 until it is within the tender port 101. At this point, repair, servicing, or removal of the system is possible. In the case of repair or servicing, the actions could be completed and the sub-surface activities resumed. In the case of removal, the well head adapter could be removed or left for subsequent reconnection.

In the present implementation, two robotic drills 107, 113 are presented. This is not meant to require two robotic drills nor is it meant to limit the system to two robotic drills, as one or more robotic drills may be used. For example, 3, 4, or 5 robotic drills could be used.

In one implementation, the robotic tender system 114 includes a robotic management tender 104 and a robotic drill tender 106. This is not meant to require two separate components to perform the functions of these tenders, but that it is possible to conduct tether management and initial drill orientation directly in the robotic drills. Conversely, it is also possible to separate the tether management and orientation function for each of multiple drills into its own individual robotic drill tender. Thus, the functions of the robotic management tender 104 and the robotic drill tender 106 may be performed by a single tender or by multiple tenders, such as two or more management tenders 104 and two or more drill tenders 106.

Figure 2:
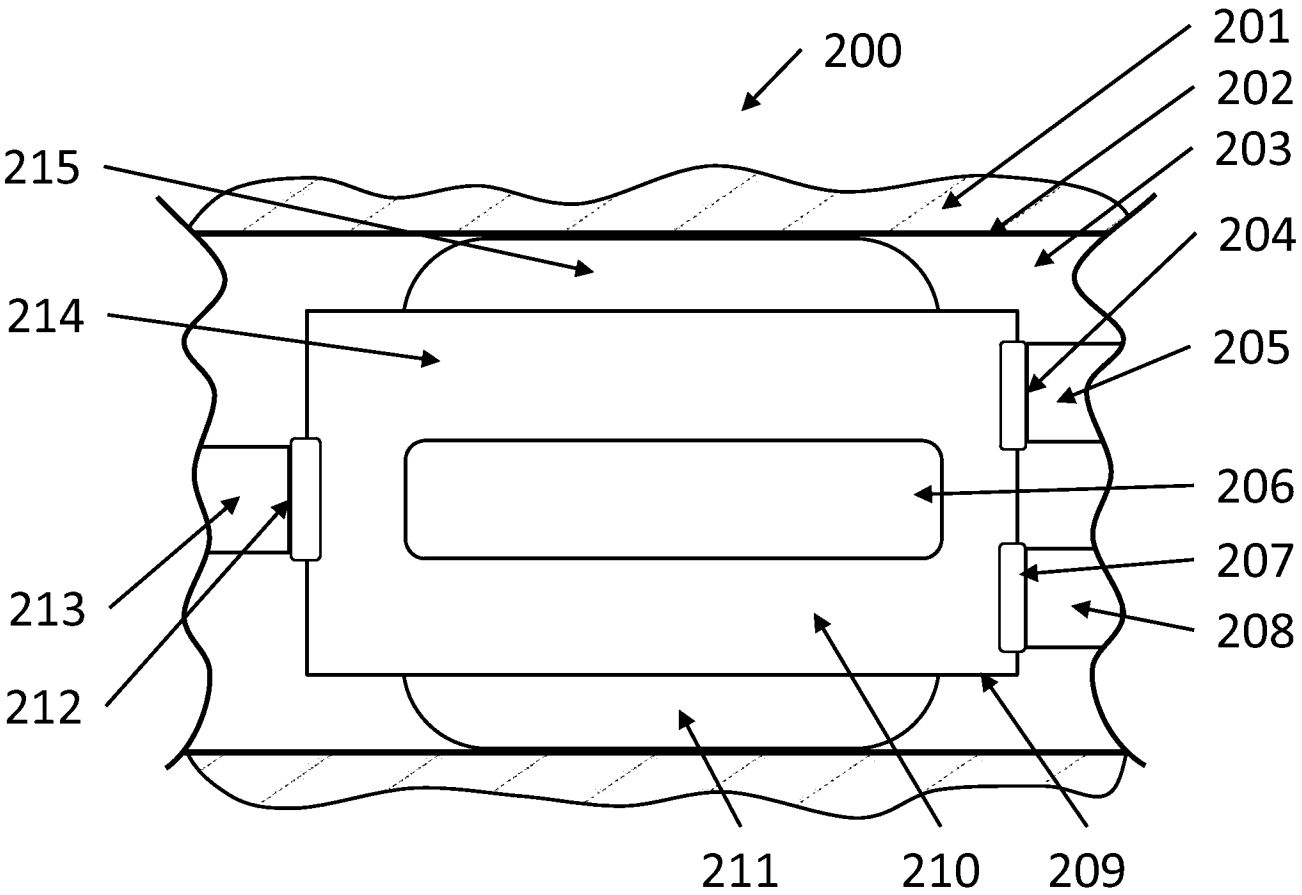
FIG. 2 is a schematic representation of the robotic management tender external view of the system as in FIG. 1.

FIG. 2 provides a schematic representation of the major external components of the robotic management tender 200 in context to the main well bore 203 and reservoir 201. The tender body 209 has the main tether 213 attached by a sealing connector 212 on the end oriented toward the surface of the well. On the opposing, down-well side, the intermediate tethers 205, 208 are attached by sealing connectors 204, 207, respectively, to the tender body 209. External components of the locomotion systems 206, 211, 215 are here depicted as elongated segments which can either be stepping inchworm devices or traction devices which are in contact with the main well bore wall 202. Movement of the robotic management tender will occur by stepping the inchworm, wheeled, or tracked device forward or backward. By minimizing the required contact surface area necessary for acceptable traction, void space 214, 210 is established around the tender body 209 which allows fluids in the well bore to bypass it. While this representation shows two intermediate tethers 205, 208 connected to the robotic management tender 200, it is not intended to require two nor is it limited to two. For example, one intermediate tether or more than two intermediate tethers may be used.

Figure 3:
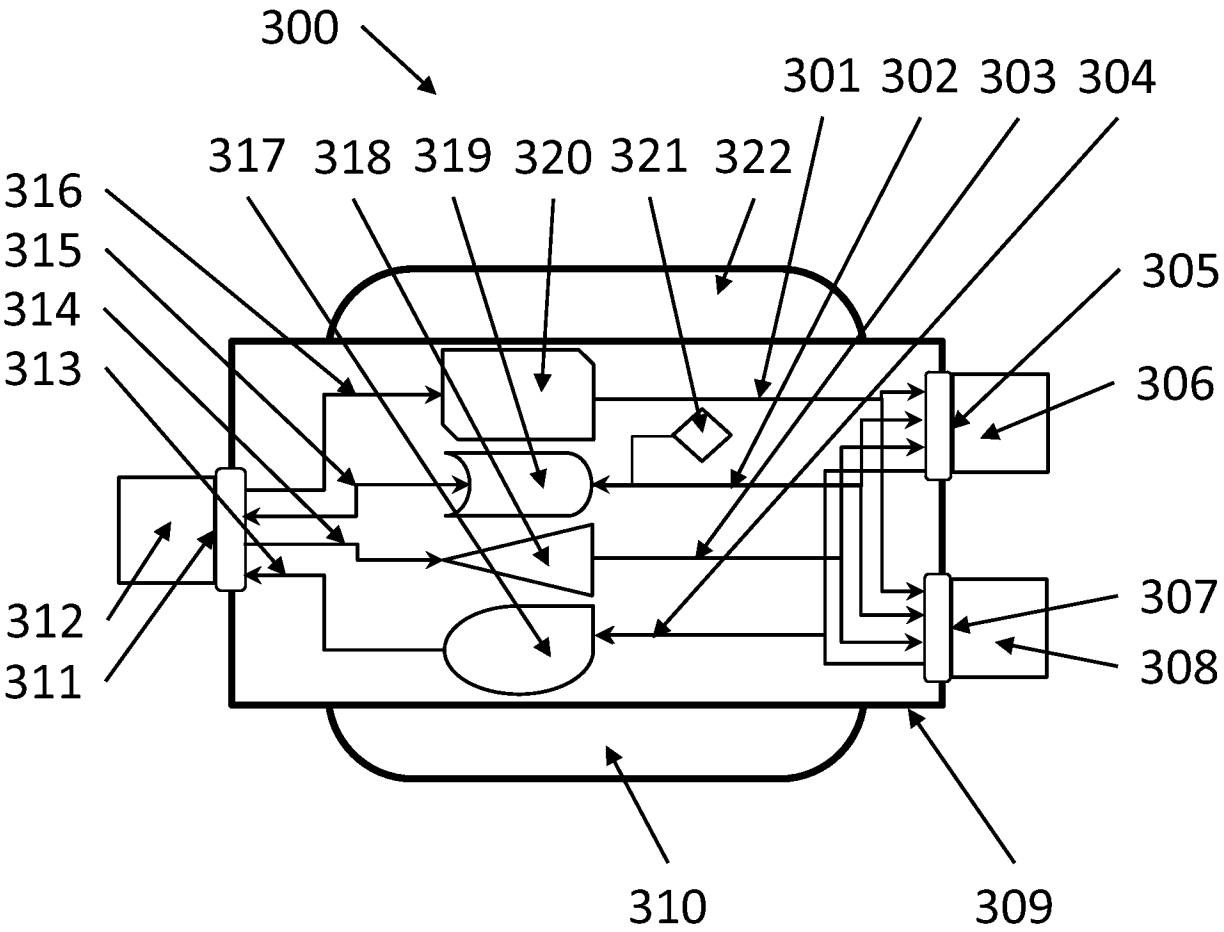
FIG. 3 is a schematic representation of the robotic management tender internal view of the system as in FIG. 1.

A diagrammatic representation of the internal systems of the robotic management controller 300 is presented in FIG. 3. The tender body 309 has a single main tether 312 connected via a sealing connector 311 on the side toward the well head and, in this representation, two intermediate tethers 306, 308 with respective sealing connectors 305, 307. For reference, two of the external locomotion systems 310, 322 components are also shown. At the main tether 312 side of the tender body 309 are a series of lines representing flows of material, power, and data with arrowheads indicating the direction of flow. Essential to the process of drilling is the provision of cutting fluid to the drill bit. This helps cool and lubricate the drill bit as it cuts and carries away the cutting. The inbound drilling fluid line 316 routes the fluid to the drilling fluid manager 320 which senses the input volume and pressure, may provide additional pressure through internal pumping, and forwards the fluid to the outbound drilling fluid line 301 and out the intermediate tethers 306, 308 which is here indicated as a split line but which would each be independently controllable to accommodate the demands of the robotic drill. Fluid is returned to the robotic management tender from the drill bit through the intermediate tethers 306, 308. The inbound cuttings and spent drilling fluid line 304 transports the fluid to a drainage system pump 317 which pumps it to the surface through the outbound cuttings and spent drilling fluid line 313 via the main tether 312. Flow and pressure control valves would be in each inbound line to manage the flow through the system and pressure at the collection port on each robotic drill. The drainage system pump 317 would provide necessary pressure profiles to these valves and provide pumping pressure to raise the fluid to the surface for processing by the surface controller. Electrical power is provided to the subsurface components initially by the inbound power line 314 which is converted to usable voltages and currents by the power manager 318 then appropriately distributed to the robotic drills via the outbound power line 303 and the intermediate tethers 306, 308. Communications between the internal computer/controller system 319 and the surface controller is accomplished by the wellhead bidirectional data line 315 and between the computer/controller system 319 and the robotic drills via the drill side bidirectional data line 302 which communicate through the intermediate tethers 306, 308. A sensor system 321 receives its electrical power from the power manager 318 and communicates with the computer/controller system 319.

In one implementation, a primary task of the robotic management tender 300 is to actively manage fluid flow to and from the robotic drills and the surface controller via the intermediate 306, 308 and main 312 tethers. The surface controller will provide appropriate drilling fluid at a pressure determined by conditions in the well through a separate hose within the main tether 312. Because the main tether 312 may be as long as about 8000 feet, some pressure loss may be experienced which can be supplemented using the pumping system within the drilling fluid manager 320. This same pump and control valves can ensure the proper pressure at each robotic drill. Sensors at the robotic drill can indicate the need for increased or decreased pressure and communicate it to the computer/controller which actuates the pump and valve system in order to meet demand and, if appropriate, communicate with the surface controller for additional pressure or fluid. In turn, limitations to fluid pressure or flow may adjust the rate of penetration of the robotic drills and can be assessed and controlled in a cooperative manner between the surface controller, computer/controller 318, and robotic drills. The drilling fluid is passed to each robotic drill by a separate drilling fluid hose within each of the intermediate tethers 306, 308. Cuttings and spent drilling fluid is captured at the tether end of the robotic drill in order to prevent buildup of cuttings in the branch well bore which would stick the robotic drill. As with conventional drilling these cuttings are to be suspended in the spent drilling fluid, but unlike conventional drilling the fluid is not passed into the branch well bore under a pressure and fluid volume sufficient to flow it to the surface. Instead, the fluid is directed into the fluid capture system and to the robotic management tether through a separate fluid drain hose by management of pressure at the inlet slots. The drainage system pump 317 and related valves are actuated under the control of the computer/controller to establish a pressure profile at the cuttings capture system that reduces those which would bypass the rear seal on the robotic drill. Once in the drainage system, the drainage system pump 317 can also provide the necessary pressure to pump the cuttings and spent drilling fluid to the surface through a separate hose in the main tether 312. This system of controls, pressures, pumps, valves, and sensors allows significant control of the flow of the fluid system and offers the opportunity to adjust pressures of the inbound as well as outbound systems independent of the formation and fluid pressures. As a result, improved rate of penetration, reduced formation damage, or reduction in fluid losses may be possible.

In one implementation, electric power passed from the surface controller is subsequently used to drive an electric motor within the robotic drills. However, this is not meant to imply that it is an essential method for driving the robotic drills. As an alternative, the drill fluid manager 320 pump could be increased in size and power such that the power to the robotic drill mechanical drilling system is through hydraulically driven mud motor in the robotic drill.

Electric power must be passed from the surface controller to the robotic management tender 300 over distances as much as about 8,000 feet via a pair of shielded or coaxial wires. The length of the wires may dictate the use of high voltage alternating current over this distance to reduce losses in the conductors themselves. In this case, the power manager 318 will step the voltage down and provide rectification and conditioning to power more appropriate for the subsurface systems. Additional lengths may require intermediate robotic management tenders.

Figure 4:
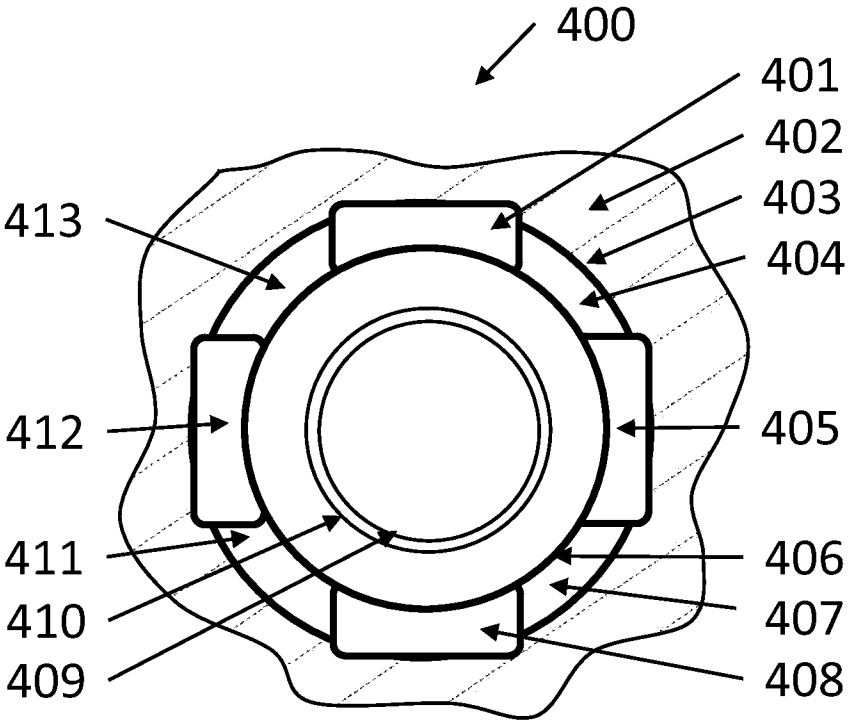
FIG. 4 is a schematic representation of the main tether end of the robotic management tender external view of the system as in FIG. 1.

Important to the design of this implementation is the ability of fluid to bypass the body of any vessels in the main well bore in order for continued production while drilling. FIG. 4 provides an end view of the main tether 409 and sealing connector 410 end of the robotic management tender 400 within the main well bore 403. In this representation, the locomotion system components 401, 405, 408, 412 external to the tender body 406 are in contact with the main well bore 403 wall within the reservoir 402. Significant void space 404, 407, 411, 413 remains for fluid flow bypass.

Figure 5:
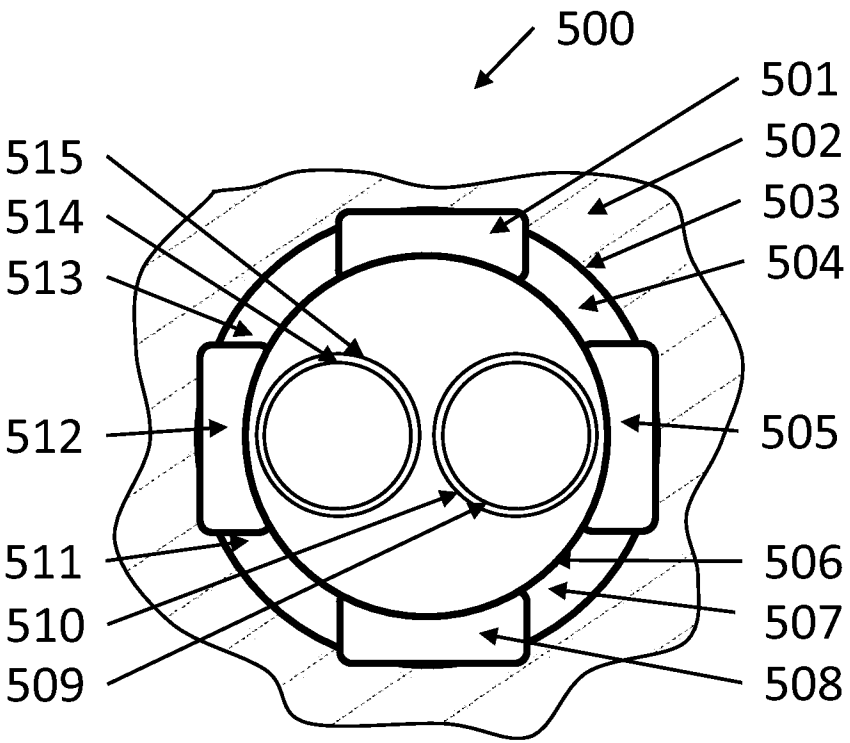
FIG. 5 is a schematic representation of the intermediate tether end of the robotic management tender external view of the system as in FIG. 1.

A diagrammatic view from the intermediate tether end of the robotic management tender is shown in FIG. 5, which provides the opposing end view of the robotic management tender 500 showing the intermediate tethers 509, 514 and sealing connectors 510, 515 of the robotic management tender body 506 within the main well bore 503. In this representation, the locomotion system external components 501, 505, 508, 512 are in contact with the main well bore 503 wall within the reservoir 502. Significant void space 504, 507, 511, 513 remains for fluid flow bypass. Therefore, the device in the main well bore 503 should not impede continued production.

Figure 6:
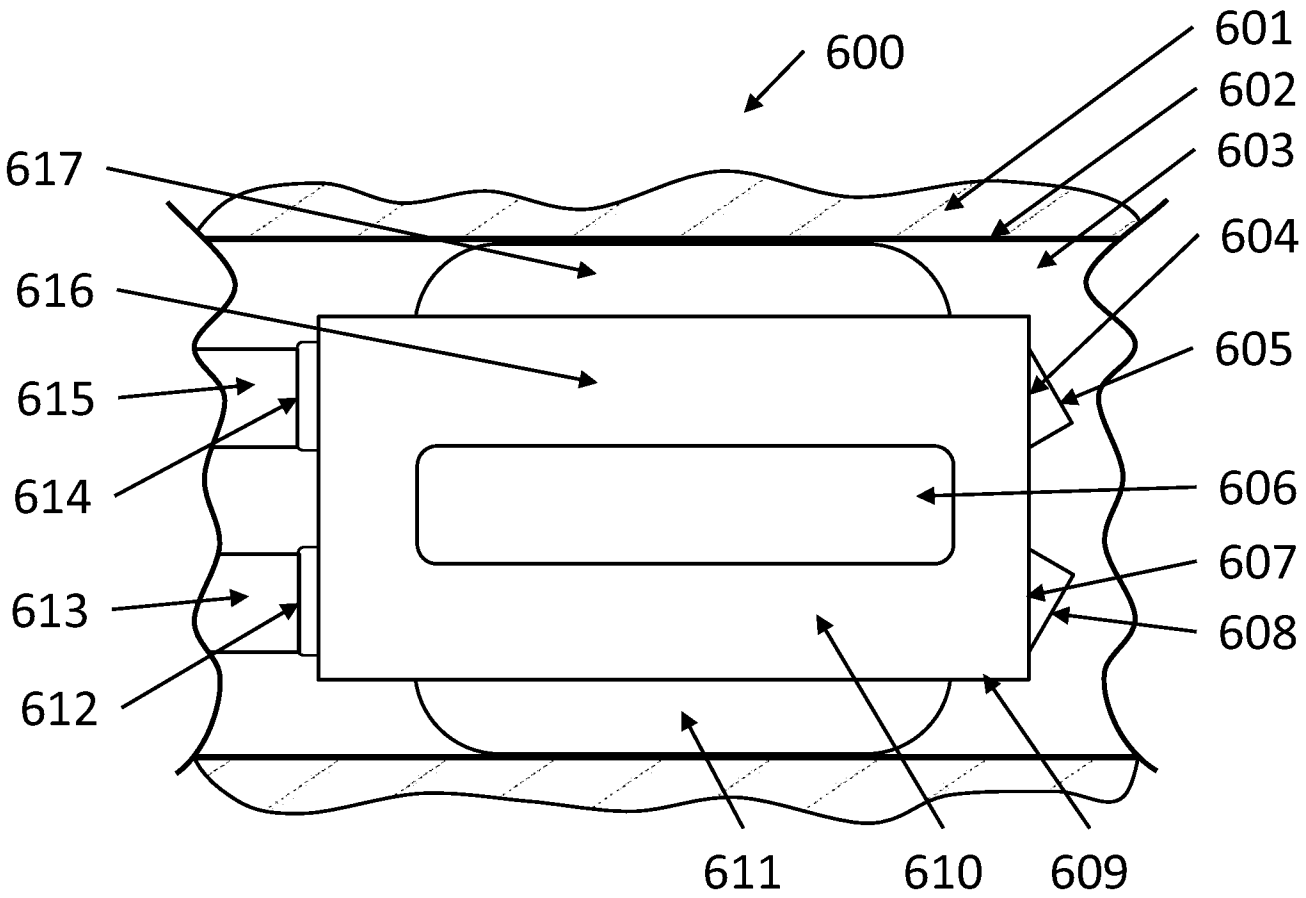
FIG. 6 is a schematic representation of the robotic drill tender external view of the system as in FIG. 1.

FIG. 6 provides a schematic representation of the major external components of the robotic drill tender 600 in context to the main well bore 603 and reservoir 601. The tender body 609 has the intermediate tethers 613, 615 which pass through the tether control system 612, 614 on the end oriented toward the robotic management tender. On the opposing, down-well side, the robotic dill bays 604, 607 with the robotic drill ports 605, 608 oriented forward and at an angle with respect to the tender body 609. External components of the locomotion systems 606, 611, 617 are here depicted as elongated segments which can either be stepping inchworm devices or traction devices which are in contact with the main well bore wall 602. Movement of the robotic management tender will occur by stepping the inchworm, wheeled, or tracked device forward or backward. By minimizing the required contact surface area necessary for acceptable traction, void space 610, 616 is established which allows fluids in the well bore to bypass it. While this representation shows two intermediate tethers 613, 615 connected to the robotic drill tender 600, it is not intended to require two nor is it limited to two. For example, one, two, three, or more intermediate tethers may be used.

Figure 7:
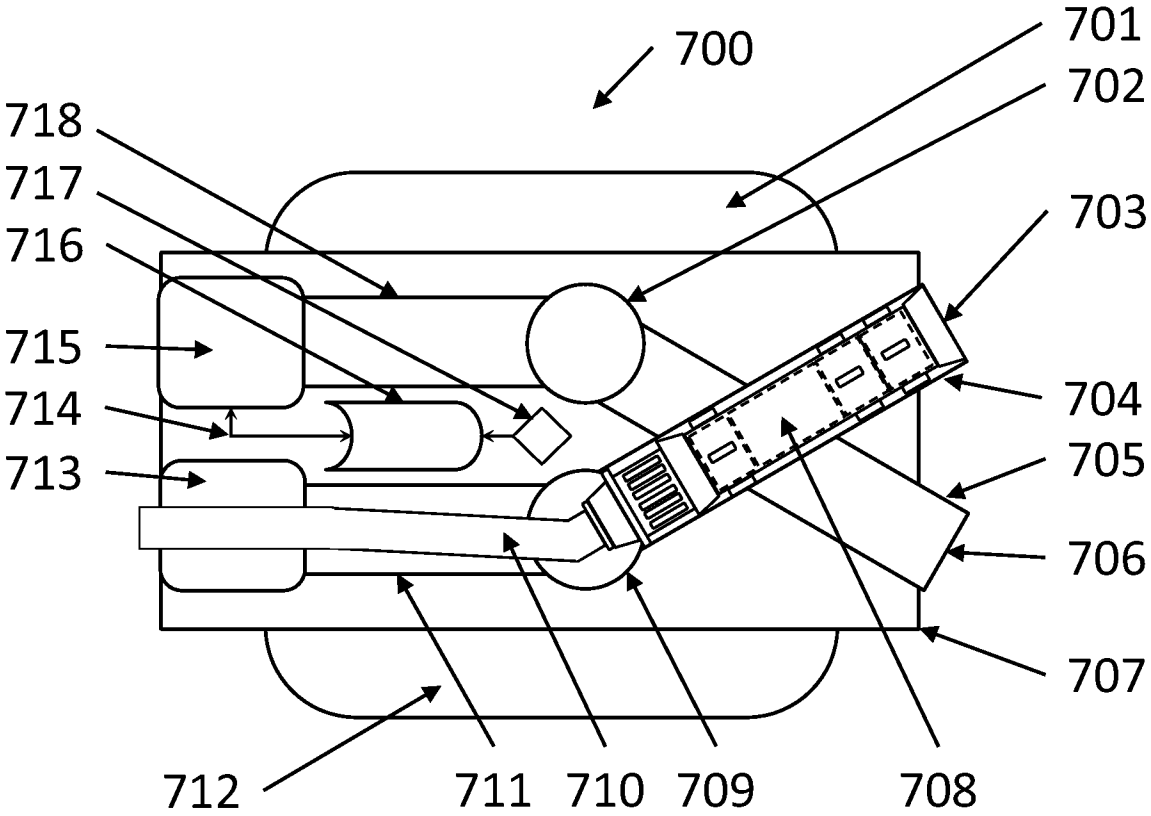
FIG. 7 is a schematic representation of the robotic drill tender internal view of the system as in FIG. 1.

FIG. 7 provides a schematic representation of the major internal components of the robotic drill tender 700. The tender body 707 has intermediate tether control systems 713 on the robotic management tender side which allow the intermediate tether 710 to pass through and into the tether guide 711 through the orientation mechanism 709 and connects to the robotic drill 708 which is housed in the robotic drill bay 703. An external view of these internal components are also shown depicting the second drilling system. The intermediate tether control systems 715 on the robotic management tender side that allow the intermediate tether to pass through and into the tether guide 718 through the orientation mechanism 702 and connects to the robotic drill that is housed in the robotic drill bay 705. An opening through which the robotic drill 708 exits the robotic drill bay 704, 705 is the robotic drill port 703, 706, respectively. These may be oriented by the respective orientation mechanism 702, 709 such that the robotic drill can be directed into the wall of the main well bore in order to initiate drilling. The tether control system 713, 715 monitors the position and tension of the intermediate tether 710 as it passes through and contains a movement mechanism which provides tension or slack on either side of the robotic drill tender 700. This allows the robotic drill to move forward in the branch well bore without entanglement of the intermediate tether. A sensor system 717 allows the system to provide tether condition, position, orientation, and direction to the computer/controller system 716, which then activates the appropriate movement of the tether control system and informs the other components of the need to take actions of their own. Information and control between the surface controller, robotic management tender, robotic drill, and the robotic drill tender are also exchanged through a bidirectional link 714 which also provides power. For perspective, the external locomotion systems 701, 712 are also depicted.

Figure 8:
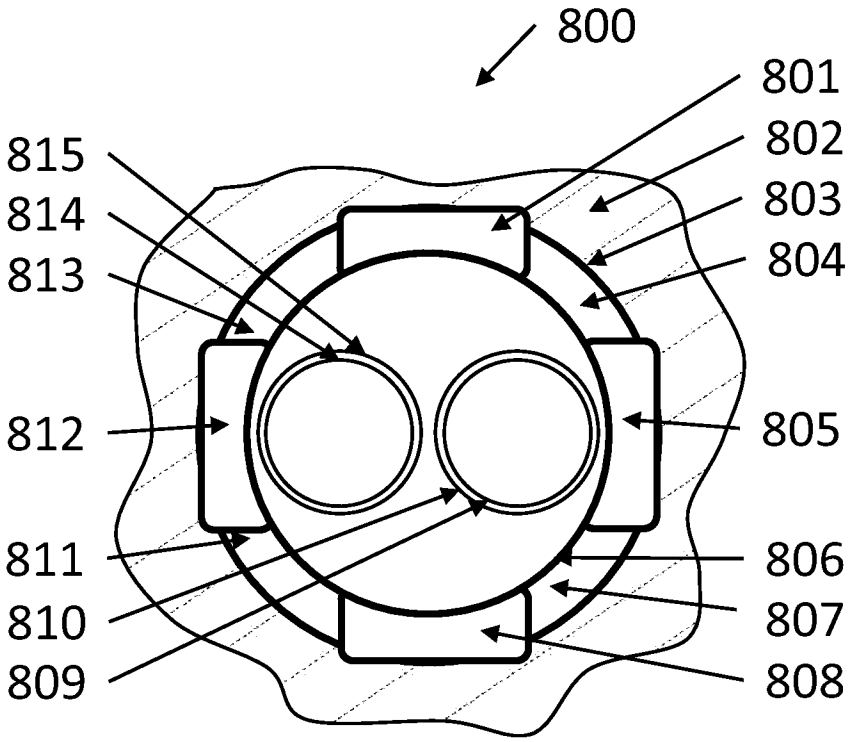
FIG. 8 is a schematic representation of the intermediate tether end of the robotic drill tender external view of the system as in FIG. 1.

Important to the design of the present invention is the ability of fluid to bypass the body of any vessels in the main well bore in order for continued production while drilling. FIG. 8 provides and end view of the robotic drill tender 800 showing the intermediate tethers 809, 814 and tether control system 810, 815, in the tender body 806 within the main well bore 803. In this representation, the locomotion system external components 801, 805, 808, 812 are in contact with the main well bore 803 wall within the reservoir 802. Significant void space 804, 807, 811, 813 remains for fluid flow bypass. Therefore, the device in the main well bore 803 should not impede continued production.

Figure 9:
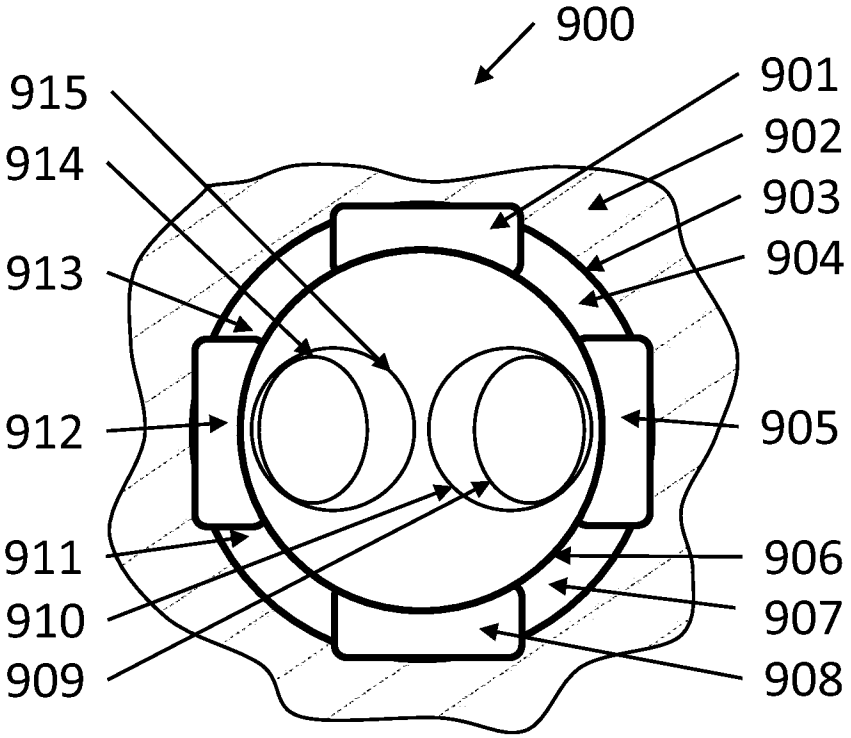
FIG. 9 is a schematic representation of the robotic drill end of the robotic drill tender external view of the system as in FIG. 1.

A diagrammatic view from the robotic drill port 909, 914 end of the robotic drill tender 900 tender body 906 within the main well bore 903 is shown in FIG. 9. FIG. 9 provides the end view showing the robotic drill bay 910, 915 and robotic drill ports 909, 914 from which the robotic drills would move from storage to initial drilling into the formation. In this representation, the locomotion system external components 901, 905, 908, 912 are in contact with the main well bore 903 wall within the reservoir 902. Significant void space 904, 907, 911, 913 remains for fluid flow bypass. Therefore, the device in the main well bore 903 should not impede continued production.

The present configuration represents a system having two robotic drills but is not meant to require two, nor prevent implementation of more robotic drills. For example, a single robotic drill may be used, or 3, 4, or more robotic drills may be used. Additionally, the orientation mechanism has been described as able to orient the robotic drill at selectable drilling angles from the axis of the main well bore. This is not to constrain the use of fixed positioning for the robotic drill. Furthermore, the angle to which the drill can be aimed will depend on the diameter of the main well bore and, therefore, the diameter of the robotic drill tender in combination with the length of the robotic drill. For example, should the formation allow use of a shorter robotic drill due to shallower penetration requirements or less power, it may be possible to drill at 90 degrees from the axis of a large main well bore. On the other hand, if the rock is hard and the expected depth is significant or the main well bore diameter is relatively small, the angle may be shallow. The ability to incorporate some directional drilling capability in the robotic drill is a desirable but not essential characteristic.

Figure 10:
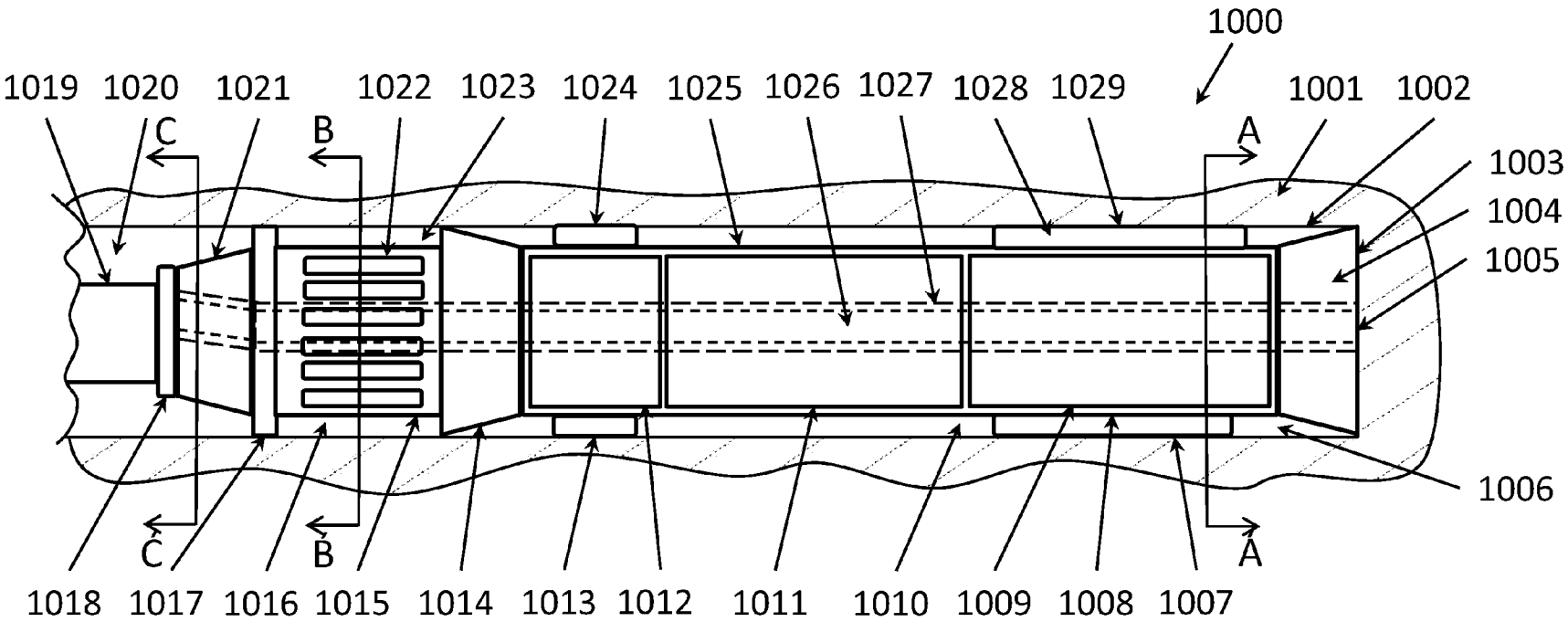
FIG. 10 is a schematic representation of the robotic drill within a branch well bore of the system as in FIG. 1.

In one implementation, a robotic drill exits the robotic drill tender bay via the robotic drill bay port using its locomotion system with the rotary drill initiating cutting into the main well bore wall at the angle set by the orientation mechanism. The robotic drill 1000 continues to extend penetration until it is fully within the branch well bore 1002 within the reservoir 1001, which is depicted in FIG. 10. At the leading edge of the robotic drill body 1008 is the drill bit 1004 with which power from the mechanical drive shaft 1027 acts to remove rock face 1003 to its front. The present invention does not require a specific drill bit, but can use roller-cone or PDC bits effectively along with others. As the bit rotates and grinds the rock face 1003, drilling fluid provided by the central cutting fluid supply channel 1026 is applied from fluid ports 1005 within the drill. This fluid lubricates and cools the drill bit and carries cuttings from the rock face into the bypass channel 1006, which includes the bypass channel 1028 around the external locomotion system 1029 toward the rear of the tool. This forms a flow of cuttings and spent drilling fluid 1010, 1025, which also bypasses the centralizers 1013, 1024 arriving at the reamer-grinder 1014. This device is connected to the mechanical drive system 1027 and produces a reaming action to gauge the wall of the branch well bore 1002. Another essential function is to provide a grinding action that reduces any cuttings that may be larger than a size that can pass easily through the capture and subsequent drain system. Sized cuttings and fluid pass into the cuttings capture space 1023, 1016 but not past the rear seal 1017.

As discussed above, the pressure profile of the entire cutting management system here described can be managed by the drilling fluid manager and the cuttings and spent drilling fluid drain system in the robotic management tender. For example, increased pressure and flow at the drill bit 1004 would decrease the density of cuttings in the stream heading toward the capture system. With the pressure somewhat above formation hydraulic pressures, the flow of cutting fluid would, depending on porosity, flow into the rock and a layer of cuttings could build up on the wall of the branch well bore 1002. However, the reamer action of the reamer-grinder 1014 would remove this layer and the decreased density of cuttings would decrease the likelihood of the reamer-grinder 1014 being overwhelmed with cuttings as it ensured they were sufficiently ground to pass through the capture system slots 1022, in to the connector head 1021 which also functions to connect the intermediate tether 1019 and its internal components via the tether adapter 1018 to the robotic drill and the drain system in general. The pump system in the cuttings and spent drilling fluid capture system in the robotic management tender would then reduce the pressure in the capture system space 1016, 1023 causing flow into the capture system 1015 through the capture system slots 1022. If this pressure was below that of the formation fluid pressure, then it would direct the flow into the slots preferentially and further enhance the effect of the rear seal 1017. Additionally, it would reduce or eliminate cuttings from passing through the rear seal 1017 and collecting in the branch well bore 1002 behind the robotic drill 1000 which might cause it to stick. Because the pressure in the collection system is independent of the formation fluid pressure, a production channel 1020 will exist behind the robotic drill.

Using example pressures to illustrate this concept makes clear that this provides a unique and valuable capability. Assuming a formation hydraulic pressure of 1000 psi and a hydraulic pressure head of 800 psi, the fluids in the formation would see a 200 psi drop from the reservoir into the well bore encouraging recovery of reserves. If the drilling fluid pressure, set by the robotic drilling tender using information from sensors on the robotic drill, is only slightly greater than that of the formation hydraulic pressure at 1100 psi, the drilling fluid will not migrate deeply into the formation causing damage to its subsequent ability to produce fluids. The pressure at the capture system could be set by the robotic drilling tender to 700 psi at the slots using sensors on the robotic drill. In this way, the cuttings and spent drilling fluid would preferentially move to the capture system, the pressure of 100 psi seen by the rear seal between the capture system surrounding void space and the open branch well bore behind the rear seal would actually be negative. This would prevent cutting from crossing the seal and may allow some leakage of production fluid in the branch well bore into the capture system. As the reamer-grinder cleans the wall, the 300 psi difference between the formation hydraulic pressure would allow flow from the formation into the capture system as well. This approach, similar to underbalanced drilling, would allow localized control over the final condition of the well bore wall and enhance production. Should circumstances warrant, the pressures could be changed to build up a barrier layer as well.

This example is provided to understand a subset of the potential interactive effects of the full robotic drilling system at the drilling interface. As was indentified in the background discussion, a primary cause of failure of all prior efforts has been a lack of attention to the management and removal of cuttings. Here the innovation of a system that capitalizes on cooperative robotics to create a positive controlled drain system is an integral but not essential component of the robotic drill. There are circumstances such as shallow drilling or drilling into vertical branches that might allow a system to be devised and employed which did not require or employ one as discussed here. Certain rock and formation conditions may also allow for simpler system should the formation pressure be high enough to allow simply sealing the rear of the robotic drill sufficiently to have natural flushing of the cuttings and drill fluid through a simplified capture and drain system.

In order to create additional branch well bore 1002, the robotic drill 1000 must move forward. To do this, a locomotion system 1007, 1029 is integral to the device. As in prior discussions of such systems, either an inchworm, wheeled, or track based system much like those used with pipe robots will be used. However, unlike both the prior devices in the invention and pipe robots in general, drilling requires significant weight on bit. Therefore, the locomotion system 1007, 1029 must also provide sufficient traction to the walls to allow the weight on bit system 1009 to cause the drill bit 1004 to function. This system may employ tracks, but is presented in this implementation as an inchworm system which has the locomotion system 1007, 1029 external to the body 1008 bind to the walls through pressure while pushing the drill bit 1004 forward on the mechanical drive shaft 1027. While this is an exemplary implementation, other ways of applying weight on bit, such as but not limited to simple tracked or wheel motion or external inchworm gripers with a fixed drive interface.

Mechanical power is provided to the bit and reamer-grinder through a mechanical drive shaft 1027. This shaft is turned by, in this implementation, one or more electric motors here shown as the mechanical drive system 1011. Electric power for the motor(s) is provided from the intermediate tether attached at the rear of the robotic drill. A computer/controller system 1012 provides power management, a sensor system, a communications interface with the other systems and sensors, and computational capability. Position, attitude, direction, and orientation provide location information. Other sensors such as locomotion system status, pressure on walls, weight on bit, are also included. Pressures are measured in the fluids along and inside the robotic drill. Based on this information, the computer controller applies the appropriate weight on bit using the locomotion and weight on bit systems and applies electric power to the electric motor(s) to drive the drill bit and the reamer grinder through the mechanical drive shaft.

While electric motors have been used in this example, it is not intended to constrain the invention to be only electrically driven. As discussed above, a scheme also exists for the electric motor to be replaced by a mud motor with minor deviation to the design.

FIG. 10 shows a particular implementation and the order of layout or position of the components internal or the detailed location of the external components are not intended to constrain the design. It may, for example, be necessary to place the computer/control elements in a distributed fashion or at the rear of the robotic drill. The electric motor or mud motor may need to be placed forward of the locomotion system. Reconfiguration of these components is expected within the scope of the invention.

Figure 11:
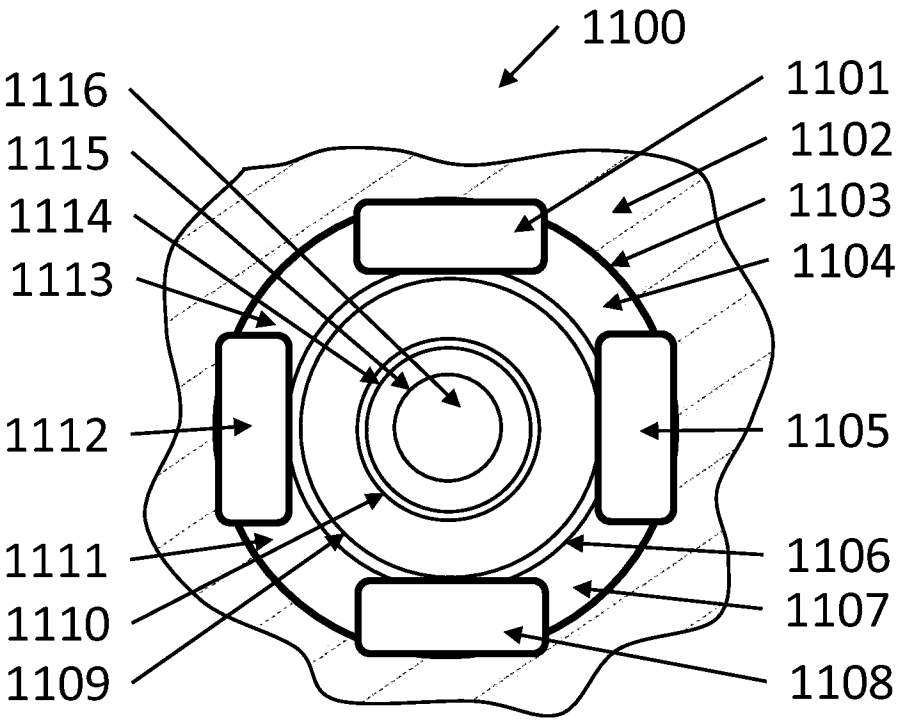
FIG. 11 is a schematic cross section view taken along line A-A" in FIG. 10.

To provide a better understanding of the present invention, FIG. 10 indicates three cross sections of the robotic drill. Section along line A-A" is presented in FIG. 11 as a cross section of the locomotion segment of the robotic drill 1100. The robotic drill body 1106 is presented in the context of a branch well bore 1103 within a reservoir 1102. Traction plates 1101, 1105, 1108, 1112 grip the wall of the well bore providing a large surface area in contact and with sufficient pressure to fix the robotic drill within the branch well bore 1103. Despite the larger size of the traction plates 1101, 1105, 1108, 1112 significant bypass channels 1104, 1107, 1111, 1113 exist to allow passage of the cuttings and spent drilling fluid as it moves from the front of the robotic drill to the rear and capture system. An internal volume houses the weight on bit pressure mechanism 1109 which, in this particular implementation, presses the bit forward. Internal to this mechanism is a bushing 1110, which allows rotation of the mechanical drive shaft 1114, which is hollow to provide a drilling fluid supply channel 1115 containing the drilling fluid channel 1116. This arrangement, which is not meant to be the only implied arrangement, but an example related to the particular embodiment presented in FIG. 10, allows flow of fluid to the cutting surface and away to the drainage system while ensuring the effectiveness of the drilling by applying sufficient force to provide a fixed positioning system with respect to the well bore walls such that weight can be applied to the bit allowing the rotation from the mechanical system to create cuttings and continue penetration.

Figure 12:
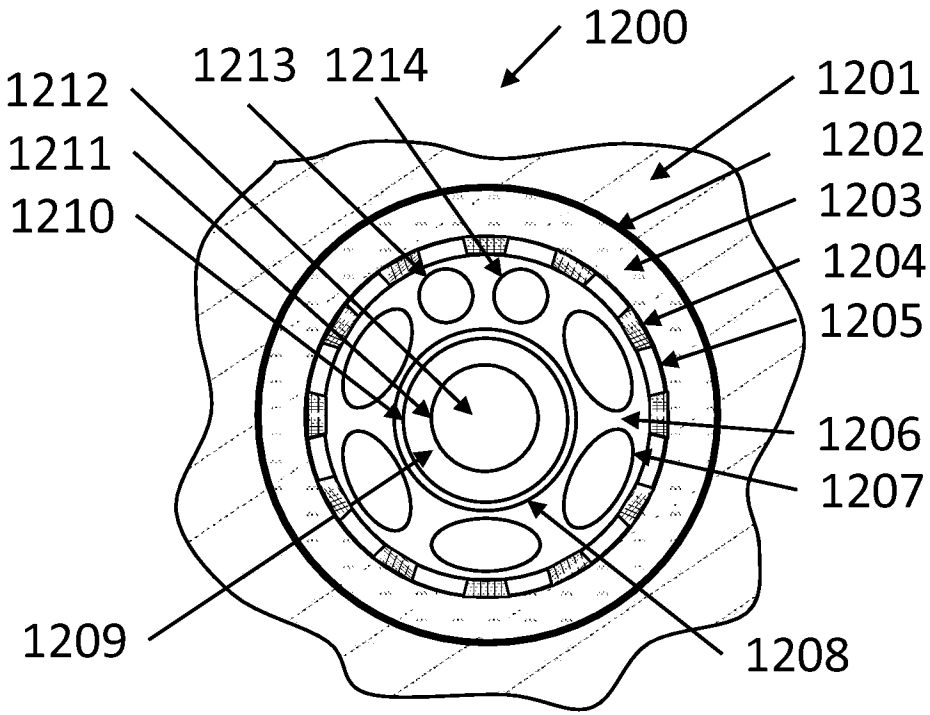
FIG. 12 is a schematic cross section view taken along line B-B" in FIG. 10.

FIG. 12 is the cross-section taken along line B-B" in FIG. 10 showing the capture system 1200 details. In this cross-section, the capture system includes the solid portion or land 1204 of the robotic wall body and slots 1205 as indicated by shaded and un-shaded wall segments. These allow flow of cuttings and drilling fluids into the capture chamber 1206 and subsequently out the drain ports 1207 represented here by five oval ports (although the ports may be other shapes). The spacing of the lands 1204 and slots 1205 ensures that no particles of cuttings can enter the capture chamber 1206 if they are of a size greater than will pass through the drain ports 1207, which, in turn, will not allow any particles to pass which might cause a stoppage in the tether or drainage system. The mechanical drive shaft 1210 is centered within a bushing 1208 and seated on a thrust bearing 1209 so that rotation is free but a forward force applied to the overall housing can be transferred to the mechanical drive shaft 1210. A drilling fluid supply channel 1211 is provided as the shaft and thrust bushing remain hollow allowing drilling fluid 1212 to move from the intermediate tether to the drill bit. While bypass flow is normally designed into the cross section segments, here the rear seal 1203 is shown tightly in contact with the branch well bore 1202 within the reservoir 1201. This prevents any significant bypass flow of the cuttings and spent drilling fluid thereby optimizing capture. The electric power tether 1213 and the communications tether 1214 must also pass through this cross section to arrive at the computer/controller system.

Figure 13:
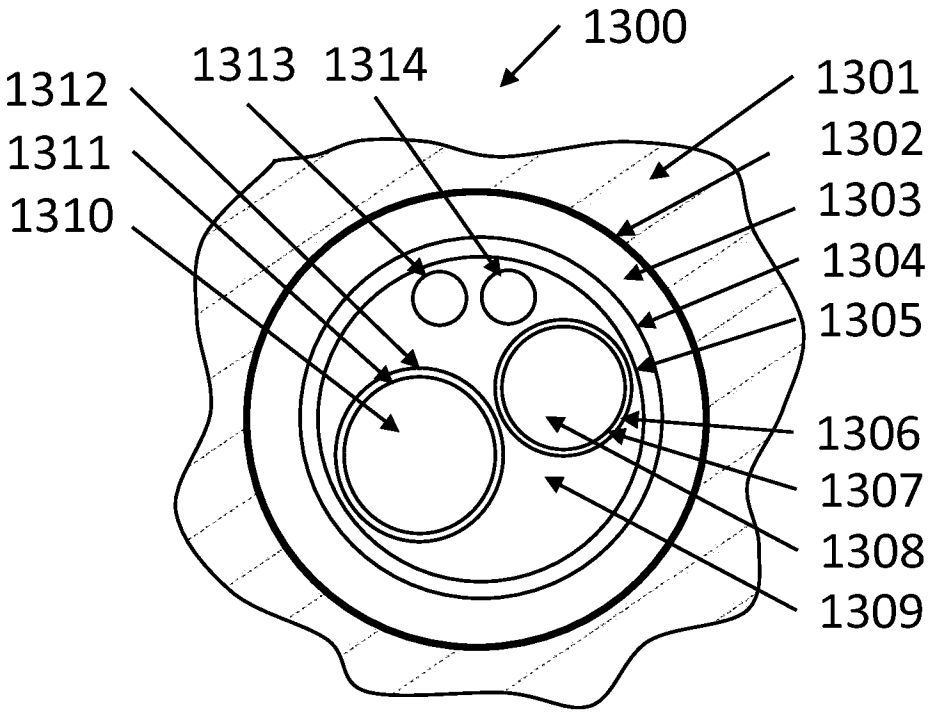
FIG. 13 is a schematic cross section view taken along line C-C" in FIG. 10.

FIG. 13 provides a cross-section taken along line C-C" of FIG. 10 and shows the connector head 1300 at the rear of the robotic drill. The connector head body 1304 isolates the drain capture chamber 1305 from the producible well bore 1303. As cuttings and spent drilling fluid pass through the drain ports shown in FIG. 12, they enter the drain capture chamber 1305 and have only one path to follow. The larger connection provides a drain in the form of a tether drain hose 1311, which is sealed 1312 to the drain capture plate 1309 or rear wall creating a drain channel 1310. Protruding through the drain capture wall 1309 is the extension of the tether drilling fluid supply hose 1306 which is sealed 1307 to the wall. This provides drill fluid 1308 to the central shaft connection on the back of the thrust bushing shown in FIG. 12. As in FIG. 12, an electric power tether 1313 and communications tether 1314 pass through to connectors on the back of the thrust bushing mounting plate. Centralizers and the locomotion system position the rear of the robotic drill so that it the formation can produce into a production channel 1303 as soon as the robotic drill clears the rear seal from the branch well bore 1302 within the formation 1301.

Figure 14:
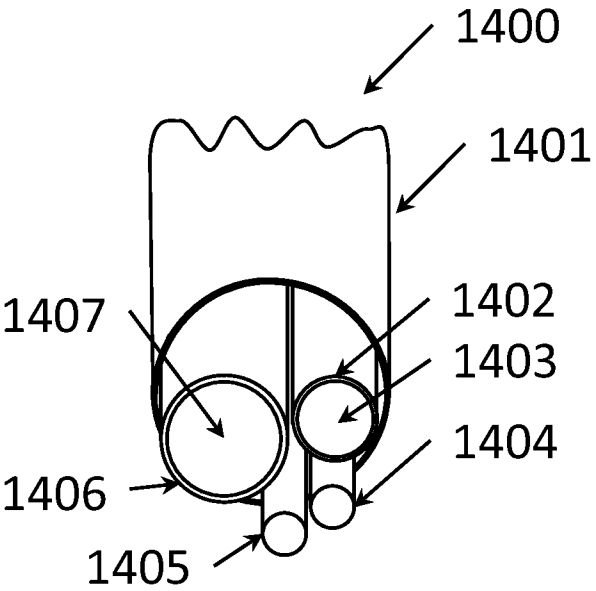
FIG. 14 is a graphical depiction of the tether system of the system as in FIG. 1.

Central to the operation of the robotic drilling system is the tether 1400 that connects all components. The composition of the tether, main or intermediate, is shown if FIG. 14 and differ only in size, strength member, and outer protective layer. Internal to the tether shown in FIG. 14 is the drill fluid hose 1402 that provides a channel to bring forward drilling fluid 1403, the drain hose 1406 which carry cuttings and spent drilling fluid 1407 away ultimately for processing on the surface, a power tether 1405 that may be designed for higher voltage and more modest current to bridge long distances such as the about 8,000 feet from surface to robotic management tender or lower voltage and higher current to drive more powerful motors and actuators at the end of about a 2,000 foot intermediate tether, and a bidirectional communications tether 1404 connecting all system components. The strength member may be an independent component or integrated into a high durability exterior cover 1401. The tethers remain flexible and are sized to the robotic systems which are, in turn, sized to the well and well conditions.

While the invention has been described in conjunction with specific exemplary implementations, it is evident to those skilled in the art that many alternatives, modifications, and variations will be apparent in light of the foregoing description. Accordingly, the invention is intended to embrace all such alternatives, modifications, and variations that fall within the scope and spirit of the appended claims.

What is claimed is:

1. A robotic drilling system for sub-surface drilling of a well bore within a reservoir, the system comprising:
- a surface controller;
- a main tether line;
- a robotic management tender connected to and in communication with the surface controller by the main tether line;
- one or more robotic drill tenders;
- one or more robotic drills; and
- one or more intermediate tether lines each connecting the robotic management tender to a robotic drill through a robotic drill tender;
- wherein the surface controller, robotic management tender, one or more robotic drill tenders, and one or more robotic drills are in communication with each other, such that the system provides power and drilling fluid to the robotic drills.

2. The system of claim 1, wherein the one or more robotic drills include internal sensors that provide their position, attitude, orientation, direction, and location information.

3. The system of claim 1, wherein the one or more robotic drill tenders each orient the one or more robotic drills.

4. The system of claim 1, wherein the surface controller controls the length of the main tether line.

5. The system of claim 1, wherein the robotic management tender and the one or more robotic drill tenders comprise an integral component of the system.

6. The system of claim 1, wherein the surface controller comprises a computer control system that includes:
- a communications interface;
- a drilling fluid supply and management system;
- a cuttings and spent drilling fluids management system;
- a power management and supply system;
- a tether management system; and
- a tender port.

7. The system of claim 1, wherein the robotic management tender comprises:
- a communication system for communicating with the surface controller and the one or more robotic drill tenders and the one or more robotic drills;
- a drilling fluid management system for controlling the flow of drilling fluid to the one or more robotic drills;
- a cutting management system for controlling the flow of cuttings out of the system;
- a power management system for controlling power to the one or more robotic drill tenders and one or more robotic drills;
- a sensor system for sensing the position of the robotic management tender; and
- a locomotion system for movement of the robotic management tender within the well bore.

8. The system of claim 7, wherein the power management system converts power sent from the surface control system to current and voltage necessary to operate the one or more robotic drill tenders and one or more robotic drills.

9. The system of claim 7, wherein the drilling fluid management system comprises a controller, control valves, and sensors.

10. The system of claim 9, wherein the drilling fluid management system controls the pressure of the drilling fluid within the system.

11. The system of claim 7, wherein the cutting management system further controls the flow of spent drilling fluid out of the system and further comprises a controller, control valves, and sensors.

12. The system of claim 7, wherein the cutting management system further comprises a reamer-grinder.

13. The system of claim 1, wherein each of the robotic drill tenders comprises:
- a communication system for communicating with the robotic management tender and the one or more robotic drills;
- a tether management control system for controlling the feed of the intermediate tether line to the one or more robotic drills;
- a sensor system for sensing the position of the robotic drill tender; and
- a locomotion system for movement of the robotic drill tender within the well bore.

14. The system of claim 13, wherein each robotic drill tender further comprises an orientation mechanism for orienting the robotic drill at selectable drilling angles from the axis of the well bore.

15. The system of claim 1, wherein each of the robotic drills comprises:
- a drill bit for extending the well bore;
- a mechanical power system for converting supplied energy to mechanical power;
- a locomotion system for movement of the robotic drill within the well bore;
- a weight on bit system to provide sufficient force to the drill bit to induce drilling;
- a cuttings management system for ensuring that cuttings are small enough to pass out of the system;
- a cutting fluid management system for supplying cutting fluid to the drill bit and removing spent cutting fluid from the system;

a communication system for communicating with the robotic drill tender; and one or more sensors for sensing the position and orientation of the robotic drill.

16. The system of claim 15, wherein the cutting management system further comprises a reamer-grinder.

17. The system of claim 15, wherein the mechanical power system comprises one or more electric motors.

18. The system of claim 15, wherein the supplied energy is fluid pressure and flow that is converted to mechanical power by one or more mud or fluid driven motors.

19. The system of claim 1, wherein the main tether line and the one or more intermediate tether lines comprise within an external protective sheaf one or more of:

a strength line, a drilling fluid line; a cuttings and spent drilling fluid drain line; an electric power supply line; and a communications line.

20. The system of claim 19, wherein the communications line is a bidirectional data line.

21. The system of claim 1, wherein at least one of the robotic management tender, the one or more robotic drill tenders, or the one or more robotic drills includes one or more sensors that sense information on the reservoir and well fluids.

22. The system of claim 1, further comprising a drilling fluid management system within one or more of the surface controller, the robotic management tender, the one or more robotic drills, the drilling fluid management system comprising control valves and sensors for supplying drilling fluid to the one or more robotic drills.

23. The system of claim 22, wherein the drilling fluid management system comprises one or more pumps to pump the drilling fluid through the system.

24. The system of claim 1, further comprising a tether management control system for controlling the length of the main tether line and the one or more intermediate tether lines as the robotic management tender, the one or more robotic drill tenders, and the one or more robotic drills move within the well bore.

25. The system of claim 24, wherein the tether management control system increases the length of the main tether line when the robotic management tender moves away from the surface controller and decreases the length of the main tether line when the robotic management tender moves towards the surface controller.

26. The system of claim 24, wherein the tether management control system controls the position of the intermediate tether, by moving the one or more of the robotic management tender and the one or more robotic drill tenders, as needed to maintain proper drilling conditions within the system.

27. A robotic drilling system for sub-surface drilling of a well bore within a reservoir, the system comprising:

a surface controller that includes:

a communication system for communicating with the one or more robotic drills;

a drilling fluid management system for controlling the flow of drilling fluid to the one or more robotic drills;

a cutting management system for controlling the flow of cuttings out of the system;

a power management system for controlling power to the one or more robotic drills;

a sensor system for sensing the position of the one or more robotic drills;

one or more robotic drills that include:

a communication system for communicating with the surface controller;

a sensor system for sensing the position of the robotic drills;

a locomotion system for movement of the robotic drills within the well bore;

a drill bit for extending the well bore;

a mechanical power system for converting supplied energy to mechanical power;

a weight on bit system to provide sufficient force to the drill bit to induce drilling;

a cuttings management system for ensuring that cuttings are small enough to pass out of the system; and a cutting fluid management system for supplying cutting fluid to the drill bit and removing spent cutting fluid from the system; and one or more tether lines connecting the surface controller to the one or more robotic drills;

wherein the surface controller and the one or more robotic drills are in communication with each other, such that the surface controller provides power and drilling fluid to the one or more robotic drills.

* * * * *